United States Patent [19]

DenBesten

[11] Patent Number: 4,462,638

[45] Date of Patent: Jul. 31, 1984

[54] MINING BIT WITH IMPROVED SPLIT RING RETAINER

[76] Inventor: Leroy E. DenBesten, P.O. Box 344, Valatie, N.Y. 12184

[21] Appl. No.: 335,879

[22] Filed: Dec. 30, 1981

[51] Int. Cl.[3] ..... E21C 35/18; E21C 25/46

[52] U.S. Cl. ..... 299/86; 37/142 A; 175/354; 299/92; 403/162; 403/378; 407/7; 411/300

[58] Field of Search ..... 299/86, 92; 175/354; 279/1 A, 97, 19.5, 19.7; 407/7; 37/142 A; 403/162, 154, 155, 378, 379; 411/300

[56] References Cited

U.S. PATENT DOCUMENTS 3,720,273 3/1973 McKenry et al. ..... 175/354 X 3,796,464 3/1974 Hansen et al. ..... 299/92 X 4,201,421 5/1980 DenBesten et al. ..... 299/86

*Primary Examiner*—Ernest R. Purser

*Attorney, Agent, or Firm*—Kane, Dalsimer, Kane, Sullivan & Kurucz

[57] ABSTRACT

In a mining machine or the like which incorporates cutting bits having conically shaped heads and located in sockets of bit holders having respective wear sleeves located on the shanks of the bits with the bit free to rotate with the sleeve interposed between the socket preventing wear mount; a retainer is provided maintained by the mount and engageable with a receptacle on the sleeve to insure against undesired ejection of the bit.

4 Claims, 2 Drawing Figures

FIG.1
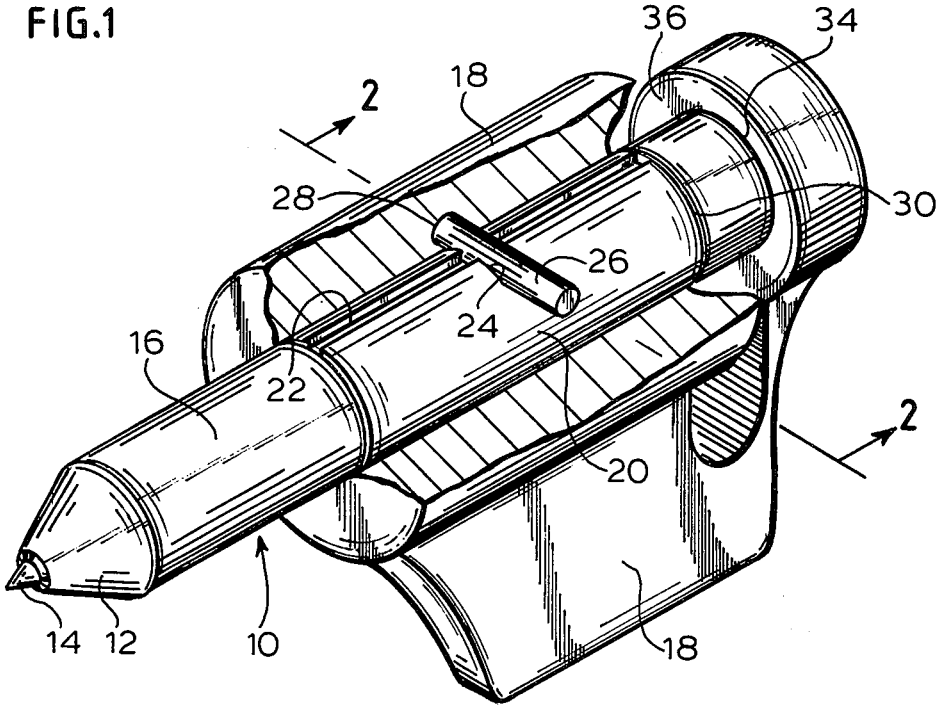
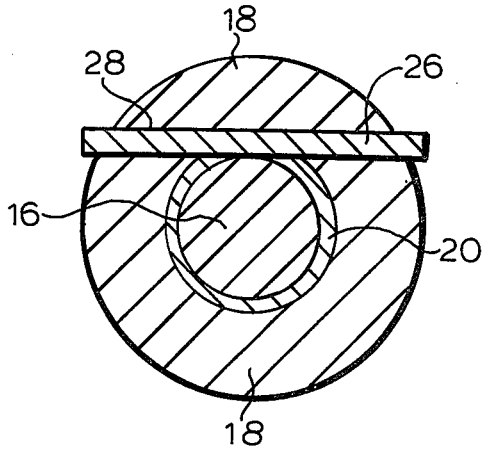
FIG.2

MINING BIT WITH IMPROVED SPLIT RING RETAINER

FIELD OF THE INVENTION

The present invention relates to an improved mining bit and mounting.

BACKGROUND OF THE INVENTION

There are many known forms of mining or cutting bits having conical heads and cylindrical shanks provided with various forms of means for mounting the bit in holders or mounts which allows for rotation of the bit therein to provide an even distribution of wear. Examples of these may be found in U.S. Pat. Nos. 3,512,838 issued May 19, 1970; 3,519,309 issued July 7, 1970 and 1,550,669 issued Aug. 25, 1925. Recently it has become popular to provide a wear sleeve between the stem or shank of the bit and the socket of the mount to, among other things, prevent wear on the shank of the bit while also retaining the bit in the socket. This type of bit arrangement is disclosed in my U.S. Pat. No. 4,201,421 issued May 1, 1980, which has been found immanently satisfactory to the trade.

In certain applications, particularly high speed operation, it is desirable to mount the bit so as to provide added insurance that the bit won't be prematurely ejected from the mount presenting a dangerous situation, while allowing the use of the wear sleeve as described in my aforenoted patent.

SUMMARY OF THE INVENTION

Accordingly, it is an object of the invention to provide for a shank of a bit in the supporting socket having a wear sleeve between the shank of the bit and the inner wall of the socket to prevent wear on the shank while including a means of insuring against premature ejection of the bit and sleeve in high speed operation.

Another object of the invention is to provide cutter bits which are mounted in such a fashion as to be readily removed and replaced at a relatively low cost keeping the mining machine in prime working condition with a minimum amount of down time.

A further object of the invention is to allow for the use of a wear sleeve between the shank of the bit and the socket without interferring with the rotation within the sleeve while having a retaining means which does not interfer with this rotation.

The present invention provides that a sleeve of cylindrical form with a longitudinal slot extending the full length of the sleeve be inserted along with the cutter bit, interposed essentially between the stem of the bit and the socket effecting a wear sustaining function while providing a holding of the bit located in the mounting block. A transverse slot in the sleeve is also provided which may be partially disposed through the longitudinal slot. The mounting block is provided with a bore transverse to the socket in which a pin is inserted and maintained by the mount after the bit has been fully inserted into the socket.

When worn out, the pin is removed and the bit and sleeve are replaced by simply forcing the bit and sleeve out of the socket and substituting a fresh bit unit by forcing it into the mounting socket and replacing the pin. This may be readily accomplished by the use of a portable pneumatic or hydraulic cylinder unit depending on the looseness of the sleeve which even if loose retains the bit due to the sleeves engagement with the sleeve. Also the sleeve is made non-rotatable by the pin while the bit would still rotate. Because the sleeve is interposed between the bit and the socket, the wear that usually results on the surface of the mount socket and the stem of the bit is reduced or eliminated. Because of the pin and sleeve arrangement, the bit is securely retained in the mounting even at high speed operation.

These and other objects and advantages may be obtained by the use of the cutter bit and mounting while providing a pin retainer to insure against premature ejection of the bit during high speed operation.

BRIEF DESCRIPTION OF THE DRAWINGS

FIG. 1 is a perspective, partially sectional view of the cutting bit and mounting incorporating the teachings of the present invention.

FIG. 2 is a section view along line 2—2 of FIG. 1.

DETAILED DESCRIPTION OF THE PREFERRED EMBODIMENT

Referring now to the drawings, there is shown a cutting bit 10 having a conical head 12 in which is maintained a pointed insert 14 which may be made of a carbide metal. The stem or shank 16 of the bit 10 is inserted into a cylindrical socket in the mount 18 with the shank also being cylindrical in shape and having located about it a wear sleeve 20. The sleeve may be made of spring steel if so desired and is provided with a longitudinal slot 22 extending its entire length. A vertical slot 24 is also provided into which a pin 26 can be passed through.

The pin 26 may be made of metal and is supported snugly by a bore 28 in the mount shown most clearly in FIG. 2. Note that the pin 26 may be longer than the bore 28 to allow for grasping and removal when replacing the bit 10.

As can be seen in FIG. 1, the shank 16 of the bit within the mount 18 is embraced by the sleeve 20 disposed thereabout in a channel portion of the shank 16 formed by a reduced diameter of the shank 16 and annual surfaces 30 and 32. The wear sleeve 20 acts as a buffer between the bit 10 and the mount 18 absorbing wear that might result on the socket surface or the bit due to the rotation of the bit.

At the rear end of bit 10 is a rear surface 34 which engages a stop 36 of the mount 18. The reason for this is that in operation, the force of impact of the bit 10 is transferred to the stop 36. In other designs, the head portion may be larger than the socket so as to relieve the need for a stop as shown in U.S. Pat. No. 4,201,421. The present invention may be utilized on either of these designs in addition to others readily apparent.

Assembly of the bit 10 would first involve placing the sleeve 20 onto the shank 16 of the bit 10. This would be accomplished by passing the sleeve 20 over the head 12 of the bit 10 and sliding it down the shank 16 into the channel portion. A certain amount of resiliency on the part of the sleeve 20 is desired. The bit 10 with sleeve 20 may then be inserted endwise into the socket of the mount 18 into abutment with the stop 36. The forward surface 32 engages the sleeve 20 forcing it contemporaneously into the socket. The sleeve may undergo contraction during this, the extent of which would depend on the respective diameters of the socket and sleeve 20. The pin 26 could then be inserted through bore 28 and slot 24. During operation, the sleeve 20 and the shank 16 in conjunction with the pin 26 insures that even in high speed operation the bit is not ejected which can only be done when the pin 26 is removed.

In this regard, when it is desired to replace the bit 10, the pin 26 is removed and the bit 10 extracted which likewise extracts the sleeve 20 due to its engagement with rear surface 30.

Thus the aforenoted invention readily realizes its objects and although a preferred embodiment has been disclosed and described in detail herein, its scope is in no sense limited thereby, rather it should be determined by that of the appended claims.

What is claimed is:

1. For use in a cutting machine device or the like having a mount with a tubular cylinder socket, a bit having:

cylindrical shank having a front cutting end and rear end with a channel portion said ends;

split cylindrical spring sleeve located in said channel portion and adapted to be disposed in and engageable with the socket over substantially all of the shank disposed in the socket so as to accept wear therebetween, said sleeve having diameter greater than the diameter of the shank adjacent the sleeve when said sleeve is disposed on the shank and in the socket so as to allow rotation of the shank in the socket; said sleeve also having a diameter sized so as to maintain the sleeve in the channel portion upon insertion of the bit into the socket and extraction of the bit from the socket;

retaining means engageable with the sleeve and the mount with said sleeve and mount having respective receptacles for said means which when disposed therein provides a retaining force on sleeve and accordingly said bit in addition to any retaining force due to engagement of the sleeve and the socket so as to prevent premature ejectment of the bit from the socket; and wherein when the bit with sleeve is placed in the socket and the means is located in the receptacles, said sleeve is non-rotational in said socket while allowing rotation of the bit in the socket and accepts substantially all of the wear on the socket resulting from interaction as between the bit and the socket and said means is disposed in the receptacle of the sleeve and prevents ejectment of the bit from the socket during operation of the device.

2. The device in accordance with claim 1 wherein said sleeve is disposed substantially throughout the length of the channel portion.

3. The device in accordance with claims 1 or 2 wherein said receptacle is a radial slot in said sleeve, and said means is a pin maintained by the mount.

4. The device in accordance with claim 3 which includes a mount having a tubular cylindrical socket, said mount having a bore forming a transverse opening to said socket; and pin means removably maintained by the mount in the bore having a portion of said means disposed in said radial slot so as to prevent ejectment of the bit from the socket during operation.

* * * * *

UNITED STATES PATENT AND TRADEMARK OFFICE

CERTIFICATE OF CORRECTION

PATENT NO. : 4,462,638

DATED : July 31, 1984

INVENTOR(S) : Leroy E. DenBesten et al

It is certified that error appears in the above-identified patent and that said Letters Patent is hereby corrected as shown below:

On the front page of the patent it should read

--Inventor: Leroy E. DenBesten, P.O. Box 344, Valatie, New York 12184 and Cletis P. Pinkerton, 7785 Mountain Ash Drive, Mentor, Ohio 44060 --.

Column 3, line 17, after "portion" insert --between--.

Signed and Sealed this

First Day of January 1985

[SEAL]

*Attest:*

*Attesting Officer*

GERALD J. MOSSINGHOFF

*Commissioner of Patents and Trademarks*